United States Patent [19]

Hammerton

[11] 4,135,589

[45] Jan. 23, 1979

[54] INGOT MOULD SEAL

[75] Inventor: Roderic H. Hammerton, Bednall, England

[73] Assignee: Foseco International Limited, England

[21] Appl. No.: 878,953

[22] Filed: Feb. 17, 1978

[30] Foreign Application Priority Data

Feb. 18, 1977 [GB] United Kingdom ..... 6820/77

[51] Int. Cl.[2] ..... B22D 33/04; F16J 15/06

[52] U.S. Cl. ..... 277/1; 277/12; 277/213; 277/237 R; 277/DIG. 6; 277/DIG. 10; 164/137; 164/DIG. 6

[58] Field of Search ..... 277/1, 12, 200, 213, 277/215, 236, 237 R, DIG. 6, DIG. 10; 164/137, 138, DIG. 6

[56] References Cited

U.S. PATENT DOCUMENTS

| | | | |
|---|---|---|---|
| 2,251,211 | 7/1941 | Armstrong | 277/213 |
| 2,292,040 | 8/1942 | Bowers | 277/213 |
| 3,209,413 | 10/1965 | Ednell | 164/137 |
| 3,672,427 | 6/1972 | Cooley et al. | 164/137 X |
| 3,718,403 | 2/1973 | Kerschner | 277/237 X |
| 3,778,176 | 12/1973 | Pax | 277/237 X |

FOREIGN PATENT DOCUMENTS

| | | | |
|---|---|---|---|
| 230300 | 5/1958 | Australia | 277/237 |
| 1270936 | 4/1972 | United Kingdom | 164/137 |

*Primary Examiner*—Robert S. Ward, Jr.

*Attorney, Agent, or Firm*—Caesar, Rivise, Bernstein & Cohen, Ltd.

[57] ABSTRACT

A seal between an ingot mould and a base plate or between a head-box and an ingot mould is formed from a pack of flat, flexible strips, for example, of cardboard or aluminium interlinked at spaced intervals along the strips. The joints between any one strip and an adjacent strip next to one face thereof are staggered in relation to the joints between the one strip and the adjacent strip next to the other face thereof. The pack is expanded lengthwise to separate the strips where they are unjoined and form generally hexagon shaped cells and is then placed on the base plate with the longitudinal edges of the strips of the pack on the base plate. The expanded pack is arranged lengthwise into a closed figure corresponding to the shape of the ingot mould. The ingot mould is then placed on top of the expanded pack which is crushed between the ingot mould and the base plate to form the required seal. A head-box seal is similarly made between the top face of the ingot mould and the head-box.

5 Claims, 4 Drawing Figures

INGOT MOULD SEAL

This invention relates to seals between parts of metallurgical moulds.

Ingot moulds for example often comprise a hollow body part, providing the necessary walls, and a separate base plate. Molten metal may be teemed through the mouth at the top of the mould or the base plate may be designed for the molten metal to flow up through it into the mould. The interior of the mould tapers slightly but continuously in horizontal cross-section to allow the ingot to be stripped from the mould. Usually the taper is from bottom to top and the ingot is stripped by lifting the mould from the base plate. The taper may however be in the opposite direction and the ingot lifted from the mould.

Ingot moulds may have any of a variety of internal horizontal cross-sections for example square, circular, oval, flat or octagonal but usually the section is rectangular with rounded corners. For various reasons ingot moulds may be provided at the top with a so-called head-box and these, like the main part of the mould and the base plates, are usually of cast iron. The moulds have thick walls and are heavy.

It is known to try to form a seal between an ingot mould and a base plate by interposing corrugated steel sheet or strip, asbestos rope or corrugated cardboard, all of which are compressed by the heavy mould. The known sealing agents are unsatisfactory for one or more reasons, in particular spaces may remain in the joint area that are not fully sealed. During casting, molten metal may flow into these spaces and form fins at the bottom of the ingot. In the case of moulds that taper from top to bottom, this can cause serious difficulties during stripping of the ingot from the mould. Special expedients have to be used to overcome these difficulties: for example, a costly flame-cutting process has to be used to remove the fins. In any event, the formation of an ingot having fins is disadvantageous in subsequent processing.

Similar problems to those mentioned above and/or additional problems may arise in other circumstances where subsequent parts of metallurgical moulds are inadequately sealed. This applies particularly to the joint between a head-box and an ingot mould.

An object of the present invention is to alleviate difficulties of the type indicated above.

According to the present invention a method of forming a seal between adjacent parts of a metallurgical mould assembly comprises expanding at least one pack of flat, flexible, interlinked strips to form at least one array of substantially identical cells, arranging the expanded pack(s) on one of the parts between which the seal is to be formed with the longitudinal edges of the strips on one side of the expanded pack(s) resting on the one part of the mould assembly and bringing the parts of the mould assembly one towards the other so as to crush the expanded pack(s) between the parts while generally maintaining a cellular structure.

Although the cellular structure of the expanded pack gives it considerable resistance to crushing by vertical loads, the weight of the part of the mould assembly placed on the expanded pack(s) is usually sufficient to crush the expanded pack(s) to form the desired seal; an additional compressive force may however be applied.

The flexible material of the strips of the pack may be strong paper, cardboard, lightweight metal such as aluminium or other material that does not yield dangerous toxic fumes under the conditions of use. The material should be of suitable flexibility and inelasticity to enable the packs to be expanded as desired and retain the expanded configuration. If the material is inherently combustible e.g. paper or cardboard it may be given a fire-proofing treatment by use of known fire-proofing agents for the material in question or such agents may be included during the manufacture of the material. The preferred material is cardboard having a uniform thickness between about 0.1 and about 5 mm, e.g. between 0.5 and 3 mm, preferably of from 0.25 to 3 mm.

The length of each strip of the pack is preferably such that the width of the expanded pack is commensurate with the width of the joint area to be sealed e.g. the thickness of an ingot mould wall at its lower face. For a mould for a 2.5 ton ingot this thickness is typically about 11 cm, for a 10 ton ingot the figure is about 17 cm and for a 23 ton ingot the figure is about 30 cm.

The strips of the pack are preferably joined together at spaced intervals along the strips and the joints between any one strip and a strip next to one face thereof are in staggered relation to the joints between the one strip and the strip next to the other face thereof. Preferably the joints between the one face of one strip and the strip against that face are mid-way between the joints between the opposite face of the one strip and the strip against the opposite face of the one strip so that the joints between any adjacent pair of strips and the next pair are similarly disposed along the length of the strips. The expanded pack is then of a generally honeycomb appearance and the cells may be, for example, generally diamond-shaped or, preferably, generally hexagonal.

The joints preferably have an appreciable area for example extending across the full width of each strip and along the length of each strip for a distance of the order of a quarter of the length of unjoined strip between adjacent joints. The width of each strip may be of the order of one quarter or one sixth of its length but the width may be altered according to the extent of irregularities to be accommodated in the gap being sealed.

The number of strips in the pack may be chosen in accordance with the circumferential length of the joint to be sealed. The seal may be formed by use of a single pack of suitable size; the cellular structure enables the expanded pack to conform to quite sharp corners, e.g. of the base of an ingot mould wall: at corners all the cells will no longer be of substantially the same size and shape but this does not adversely affect the sealing function. The seal may also be formed by use of two or more of the expanded packs arranged end to end, e.g. to form a generally annular seal, and where these packs meet, they may abut each other or they may overlap. For example, for a mould of generally rectangular cross-section, four expanded packs may be used, one for each side of the base of the mould, and these may overlap at the corners.

If desired the outer end strips of a pack may be given a self-adhesive coating in order to ensure that the expanded pack or packs remain in the desired position. Alternatively adhesive may be applied to those faces in situ or staples or other fastening devices may be used.

It is preferred to expand the pack by pulling it from one end through a gap substantially narrower than the width of the pack i.e. the length of the strips, thereby causing the strips to separate and form an array of substantially identical cells. This can be achieved by use of apparatus comprising a support on which are rotatably mounted a pair of wheels with their axes parallel and a gap between their circumferences. By this means uniform expansion of the pack without the expanded pack tending to retract to a less expanded position is facilitated. Accordingly, in this case there is usually no need to secure the ends of the expanded pack or packs together.

A metallurgical mould between adjacent parts of which a seal has been formed by the method of the invention forms a part of the invention.

A pack suitable for use in the method of the invention forms a part of the invention. Thus, in accordance with the invention, there is provided a pack of flat, flexible strips so joined together that the pack can be expanded to form an array of substantially identical cells and the pack is so dimensioned that when expanded and arranged lengthwise the pack can form, with the longitudinal edges of the strips on one side of the expanded pack(s) in contact with one of parts between which a seal is desired, a closed figure having a shape corresponding to that of the desired seal and the expanded pack then being crushable between the parts between which the seal is desired to form the seal.

The packs can be supplied to the user in unexpanded form having a volume much less than in the expanded form. They can be packed singly or in large numbers in a container. They are convenient to store and transport and simple and clean to use.

Very importantly, the packs enable very effective seals to be formed. For example, when deformed by the weight of an ingot mould the crushed expanded pack(s) forms a seal between the mould and the base plate such that any cavities which may be left at the inside edge of the joint between the mould and base plate are extremely small and unlikely to cause fins of any significance. Furthermore even after the crushing, most if not all of the cells remain as closed, interlinked cells, although of course in crushed form, and thus, whilst the crushed cells may be open at top and bottom, there are no horizontal channels through which molten metal can penetrate right through the seal.

The packs may be used effectively both with new and worn mould parts. When used continuously from new, the useful life of the base of the mould may be considerably prolonged.

The invention is further described with reference to the accompanying drawings in which.

Figure 1:
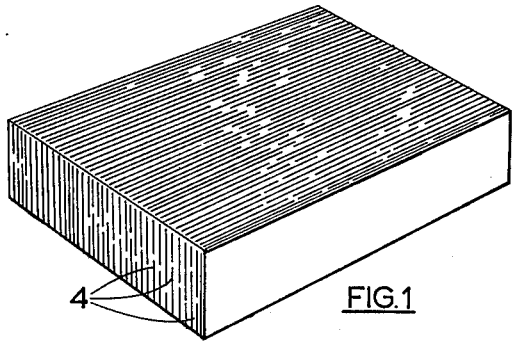
FIG. 1 is a perspective view of an unexpanded pack in accordance with the invention.

The pack comprises a plurality of interlinked strips 4, which may be about 15 cm long and about 2.5 cm wide and of cardboard having a thickness of about 0.3 mm. The strips 4 are joined together at spaced intervals along their lengths at joints 5, 5' (FIG. 2) which extend across the full width of each strip 4. The joints 5 between one face 6 of any one strip 4 and the strip 4' against that face are mid-way between the joints 5' between the opposite face 7 of the one strip 4 and the strip 4'' against the opposite face 7 of the one strip 4. Moreover each joint 5, 5' extends along each strip 4, 4', 4'' for a distance of the order of a quarter of the length of unjoined strip between adjacent joints and thus, in expanded form, the pack provides an array of substantially identical, generally hexagonal cells 8 as may be seen from FIG. 2.

Figure 2:
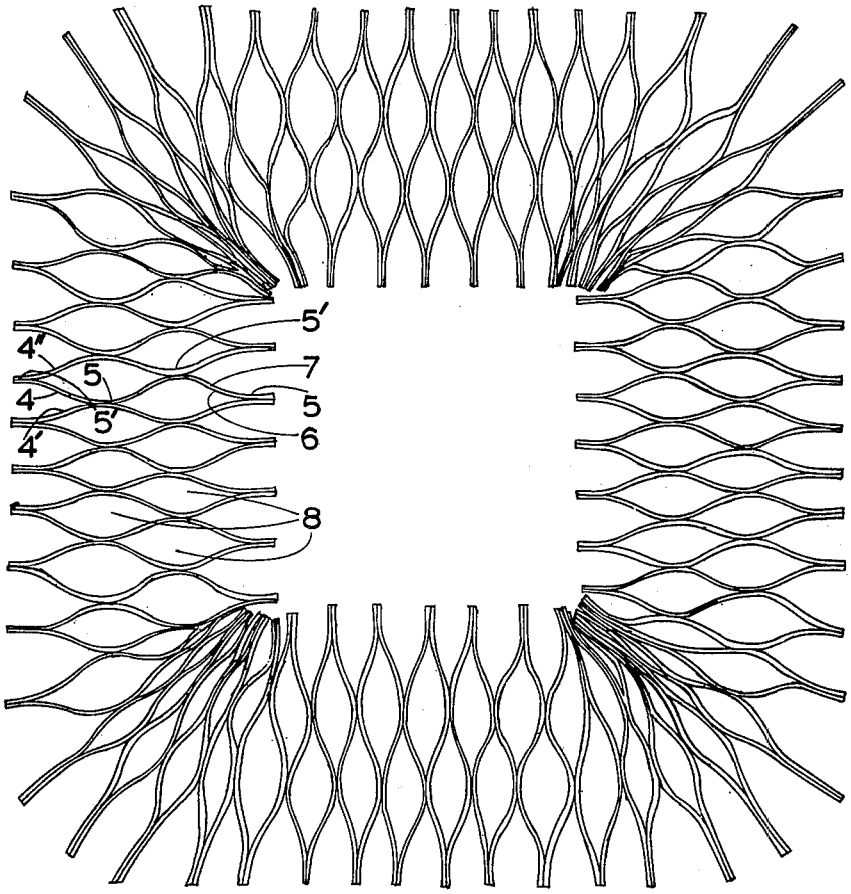
FIG. 2 is a plan view of the pack of FIG. 1 expanded and arranged to form a closed figure.
Figure 3:
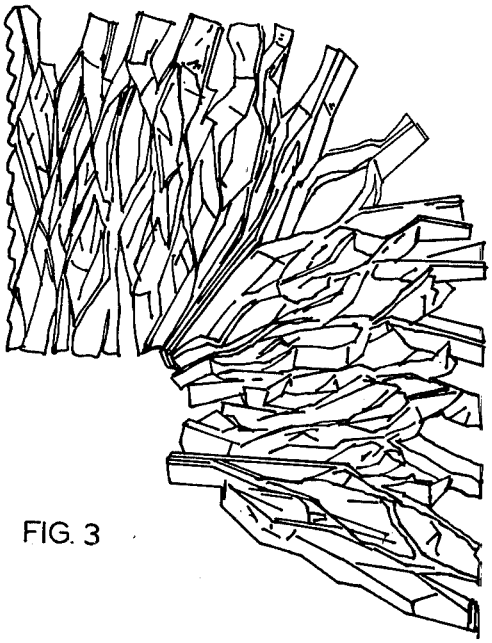
FIG. 3 shows part of the pack of FIG. 2 after crushing by a vertical load.
Figure 4:
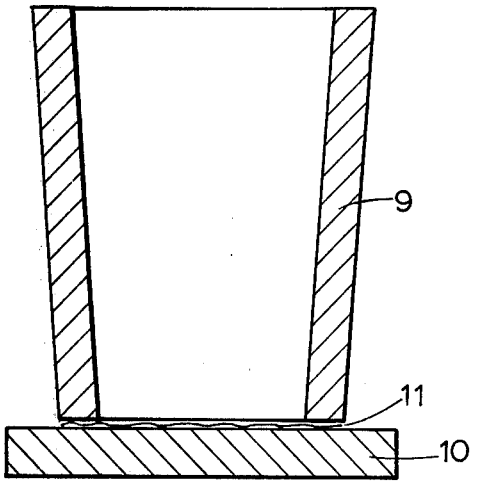
FIG. 4 is a diagrammatic vertical section through an ingot mould and base plate the joint between which has been sealed in accordance with the invention.

As shown in FIGS. 2 and 3 the expanded pack may be arranged partly in straight portions and partly around corners, for example, to form a closed figure conforming to the shape of the base of the walls of an ingot mould and may rest on the base plate on an ingot mould (FIG. 4). Alternatively, separate lengths of expanded pack may be used to correspond to each side of the ingot mould and these may overlap or abut at the corners.

It can be seen from FIG. 3 that after the crushing of the expanded pack, the closed interlinked cells 9 of generally hexagonal shape present in the uncrushed expanded pack generally remain as closed interlinked cells even though the shape of the walls is greatly distorted by the crushing. Whilst the cells generally remain open-ended at top and bottom after the crushing, the crushing does not result in horizontal channels being formed extending through the resultant seal. In consequence there is a much reduced risk of metal fins being formed when molten metal is cast in the mould.

In FIG. 4, the base of the walls of an ingot mould 9 which may be of generally rectangular cross-section, rests on a base plate 10, the joint between these having a seal 11 formed by crushing an expanded pack or packs, constructed and arranged as described above, by the weight of the ingot mould placed on the expanded pack(s) arranged on the base plate.

I claim:

1. A method of forming a seal between adjacent parts of a metallurgical mould assembly comprising the steps of selecting at least one pack of flexible strips interlined in face-to-face relation, expanding the pack to form at least one array of substantially identical cells, arranging the expanded pack on one of said parts between which the seal is to be formed with the longitudinal edges of the strips on one side of the expanded pack resting on said one part of said mould assembly and bringing said parts of said mould assembly one towards the other so as to crush said expanded pack between said parts while generally maintaining a cellular structure.

2. A method according to claim 1 in which said strips are joined together at spaced intervals along said strips and the joints between any one said strip and an adjacent said strip next to one face thereof are staggered in relation to the joints between said one strip and the adjacent said strip next to the other face thereof.

3. A method according to claim 1 in which said pack is expanded to form an array of substantially identical, generally hexagonal cells.

4. A metallurgical mould between adjacent parts of which a seal has been formed by a method according to claim 1.

5. A pack of flat, flexible strips for use in a method according to claim 1, the strips being so joined together that the pack can be expanded to form an array of substantially identical cells and the pack being so dimensioned that when expanded and arranged lengthwise the pack can form, with the longitudinal edges of the strips on one side of the expanded pack in contact with one of the parts between which the seal is to be formed, a closed figure having a shape corresponding to that of the desired seal and the expanded pack then being crushable between the parts between which the seal is desired to form the seal.

* * * * *